US009490052B2

(12) United States Patent
Stein

(10) Patent No.: US 9,490,052 B2
(45) Date of Patent: Nov. 8, 2016

(54) TUBULAR INSULATOR FOR COAXIAL CONNECTOR

(71) Applicant: Corning Gilbert, Inc., Glendale, AZ (US)

(72) Inventor: Casey Roy Stein, Surprise, AZ (US)

(73) Assignee: CORNING GILBERT, INC., Glendale, AZ (US)

( * ) Notice: Subject to any disclaimer, the term of this patent is extended or adjusted under 35 U.S.C. 154(b) by 345 days.

(21) Appl. No.: 13/928,715

(22) Filed: Jun. 27, 2013

(65) Prior Publication Data

US 2014/0004722 A1 Jan. 2, 2014

Related U.S. Application Data

(60) Provisional application No. 61/666,360, filed on Jun. 29, 2012.

(51) Int. Cl.

| | |
|---|---|
| ***H01B 17/58*** | (2006.01) |
| ***H01R 13/502*** | (2006.01) |
| ***H01R 13/631*** | (2006.01) |
| ***H01R 24/38*** | (2011.01) |
| ***H01R 43/00*** | (2006.01) |

(52) U.S. Cl.

CPC ..... *H01B 17/58* (2013.01); *H01R 13/502* (2013.01); *H01R 13/6315* (2013.01); *H01R 24/38* (2013.01); *H01R 43/00* (2013.01); *Y10T 29/49204* (2015.01)

(58) Field of Classification Search

CPC H01R 13/502; H01R 13/6315; H01R 17/58; H01R 24/38; H01R 43/00; H01R 13/10; H01R 13/28; Y10T 29/49204

USPC ..... 439/63, 578, 322, 248, 252

See application file for complete search history.

(56) References Cited

U.S. PATENT DOCUMENTS 4,624,525 A * 11/1986 Ichimura ..... H01R 9/0518 439/585
4,895,521 A 1/1990 Grabbe ..... 439/63

(Continued)

FOREIGN PATENT DOCUMENTS

DE 10202637 C1 8/2003 ..... H01R 13/11
DE 202008011118 U1 12/2008 ..... H05K 3/36

(Continued)

OTHER PUBLICATIONS

Machine Translation of JP 09-270282 A, no date.*

(Continued)

*Primary Examiner* — Neil Abrams
*Assistant Examiner* — Travis Chambers
(74) *Attorney, Agent, or Firm* — Harness, Dickey & Pierce, PLC

(57) ABSTRACT

An insulator for a coaxial connector is disclosed. The insulator is adapted to connect to a coaxial transmission medium to form an electrically conductive path between the transmission medium and the coaxial connector. The insulator is constructed of dielectric material. A laser-cut pattern in the insulator produces voids in the dielectric material such that air is incorporated into the insulator. The insulator has a composite tangent delta and a composite dielectric constant based on a combination of the dielectric material and the air and maintains dielectric properties to insulate and separate components of the coaxial connector.

15 Claims, 11 Drawing Sheets

(56) References Cited

U.S. PATENT DOCUMENTS

| | | | | |
|---|---|---|---|---|
| 4,925,403 | A * | 5/1990 | Zorzy | H01R 13/6315 439/578 |
| 5,184,965 | A * | 2/1993 | Myschik | H01R 9/05 439/578 |
| 5,203,717 | A | 4/1993 | Beck et al. | 439/460 |
| 5,273,443 | A | 12/1993 | Frantz et al. | 439/595 |
| 5,295,683 | A | 3/1994 | Tate | 273/32 |
| 5,498,175 | A | 3/1996 | Yeh et al. | 439/578 |
| 5,611,707 | A | 3/1997 | Meynier | 439/353 |
| 5,865,654 | A | 2/1999 | Shimirak et al. | 439/852 |
| 5,890,926 | A | 4/1999 | Pauza et al. | 439/445 |
| 5,906,511 | A | 5/1999 | Bozzer et al. | 439/579 |
| 6,071,127 | A | 6/2000 | Acke et al. | 439/63 |
| 6,338,653 | B1 | 1/2002 | Jones et al. | 439/579 |
| 6,398,593 | B1 | 6/2002 | Yeh | 439/723 |
| 6,692,262 | B1 | 2/2004 | Loveless | 439/63 |
| 6,699,054 | B1 | 3/2004 | Critelli | 439/248 |
| 6,827,608 | B2 | 12/2004 | Hall et al. | 439/578 |
| 7,112,078 | B2 * | 9/2006 | Czikora | H01R 13/6315 439/248 |
| 7,393,214 | B2 | 7/2008 | DiStefano | 439/66 |
| 7,718,847 | B2 | 5/2010 | Shinohara et al. | |
| 7,833,023 | B2 | 11/2010 | Di Stefano | |
| 8,172,609 | B2 | 5/2012 | Hsia | |
| 8,177,582 | B2 | 5/2012 | Amidon | 439/578 |
| 8,206,176 | B2 | 6/2012 | Islam | |
| 8,265,471 | B2 | 9/2012 | Hasegawa et al. | 396/72 |
| 8,317,539 | B2 | 11/2012 | Stein | |
| 8,475,204 | B2 | 7/2013 | Blasick et al. | |
| 8,479,383 | B2 | 7/2013 | Van Swearingen et al. | |
| 8,597,050 | B2 | 12/2013 | Flaherty et al. | |
| 8,636,529 | B2 | 1/2014 | Stein | |
| 8,641,431 | B2 | 2/2014 | Blasick | |
| 8,641,447 | B2 * | 2/2014 | Sykes | H01R 24/44 439/582 |
| 8,690,602 | B2 | 4/2014 | Flaherty, IV | |
| 2004/0038586 | A1 * | 2/2004 | Hall | H01R 13/6315 439/578 |
| 2004/0092165 | A1 | 5/2004 | Holland | 439/607 |
| 2006/0051998 | A1 | 3/2006 | Chun et al. | 439/182 |
| 2006/0084286 | A1 | 4/2006 | Kooiman | 439/63 |
| 2009/0264003 | A1 | 10/2009 | Hertzler et al. | 439/299 |
| 2011/0039448 | A1 * | 2/2011 | Stein | H01R 13/111 439/578 |
| 2011/0151714 | A1 | 6/2011 | Flaherty et al. | 439/578 |
| 2011/0195607 | A1 * | 8/2011 | De Bruijn | H01R 23/688 439/660 |
| 2011/0244721 | A1 | 10/2011 | Amidon | 439/578 |
| 2015/0132992 | A1 * | 5/2015 | Holland | H01R 24/44 439/578 |

FOREIGN PATENT DOCUMENTS

| | | | | |
|---|---|---|---|---|
| DE | 202008011119 | U1 | 12/2008 | H05K 3/36 |
| EP | 0582960 | B1 | 8/1993 | H01R 17/12 |
| EP | 1207592 | A2 | 11/2001 | H01R 13/646 |
| EP | 1434313 | A1 | 6/2003 | H01R 13/631 |
| EP | 2051340 | A1 | 10/2008 | H01R 13/658 |
| JP | 54025492 | | 2/1979 | H01B 19/00 |
| JP | 09270282 | A * | 10/1997 | |
| WO | 98/33243 | A2 | 7/1998 | |
| WO | WO98/33243 | | 7/1998 | H01R 17/12 |
| WO | WO2011/019987 | | 2/2011 | H01R 13/11 |

OTHER PUBLICATIONS

Sep. 10, 2013 EP Search Report issued in counterpart Application No. 13173910.4.

Patent Cooperation Treaty, International Search Report for PCT/US2011/027903, Jun. 29, 2011, pp. 1-2.

* cited by examiner

TUBULAR INSULATOR FOR COAXIAL CONNECTOR

RELATED APPLICATIONS

This application claims the benefit of priority under 35 U.S.C. §119 of U.S. Provisional Application Ser. No. 61/666,360 filed on Jun. 29, 2012 the content of which is relied upon and incorporated herein by reference in its entirety.

BACKGROUND

Field of the Disclosure

The disclosure relates generally to coaxial connectors, and particularly to coaxial connectors having insulators to insulate and separate components of the coaxial connector.

Technical Background

The technical field of coaxial connectors, including microwave frequency connectors, includes connectors designed to transmit electrical signals and/or power. Male and female interfaces may be engaged and disengaged to connect and disconnect the electrical signals and/or power.

These interfaces typically utilize socket contacts that are designed to engage pin contacts. These metallic contacts are generally surrounded by a plastic insulator with dielectric characteristics. A metallic housing surrounds the insulator to provide electrical grounding and isolation from electrical interference or noise. These connector assemblies may be coupled by various methods including a push-on design.

The dielectric properties of the plastic insulator along with its position between the contact and the housing produce an electrical impedance, such as 50 ohms. Microwave or radio frequency (RF) systems with a matched electrical impedance are more power efficient and therefore capable of improved electrical performance.

DC connectors utilize a similar contact, insulator, and housing configuration. DC connectors do not required impedance matching. Mixed signal applications including DC and RF are common.

Connector assemblies may be coupled by various methods including a push-on design. The connector configuration may be a two piece system (male to female) or a three piece system (male to female-female to male). The three piece connector system utilizes a double ended female interface known as a blind mate interconnect. The blind mate interconnect includes a double ended socket contact, two or more insulators, and a metallic housing with grounding fingers. The three piece connector system also utilizes two male interfaces each with a pin contact, insulator, and metallic housing called a shroud. The insulator of the male interface is typically plastic or glass. The shroud may have a detent feature that engages the front fingers of the blind mate interconnect metallic housing for mated retention. This detent feature may be modified thus resulting in high and low retention forces for various applications. The three piece connector system enables improved electrical and mechanical performance during radial and axial misalignment.

SUMMARY

One embodiment of the disclosure relates to an insulator for a coaxial connector adapted to connect to a coaxial transmission medium to form an electrically conductive path between the transmission medium and the coaxial connector. The insulator is constructed of a dielectric material. A laser-cut pattern in the insulator produces voids in the dielectric material such that air is incorporated into the insulator. The insulator has a composite tangent delta and a composite dielectric constant based on a combination of the dielectric material and the air and maintains dielectric properties to insulate and separate components of the coaxial connector.

Another embodiment of the disclosure relates to a method of insulating a coaxial connector including providing dielectric material; laser cutting the insulator in a pattern to produce voids in the dielectric material; and positioning the insulator in the coaxial connector such that the insulator insulates and separates components of the coaxial connector.

Another embodiment of the disclosure relates to a blind mate interconnect adapted to connect to a coaxial transmission medium to form an electrically conductive path between the transmission medium and the blind mate interconnect. The blind mate interconnect has a socket contact, at least one insulator and an outer conductor. The socket contact is made of electrically conductive material, extends circumferentially about a longitudinal axis, and is adapted for receiving a mating contact of a transmission medium. The at least one insulator is constructed of dielectric material and is circumferentially disposed about the socket contact and includes a body having a first end and second end and a through bore extending from the first end to the second end. The outer conductor is made of an electrically conductive material and is circumferentially disposed about the insulator. A laser-cut pattern in the insulator produces voids in the dielectric material such that air is incorporated into the insulator. The insulator has a composite tangent delta and a composite dielectric constant based on a combination of the dielectric material and the air and maintains dielectric properties to insulate and separate components of the coaxial connector.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description present exemplary embodiments, and are intended to provide an overview or framework for understanding the nature and character of the claims. The accompanying drawings are included to provide a further understanding, and are incorporated into and constitute a part of this specification. The drawings illustrate various embodiments, and together with the description serve to explain the principles and operations of the various embodiments.

DETAILED DESCRIPTION

Figure 1:
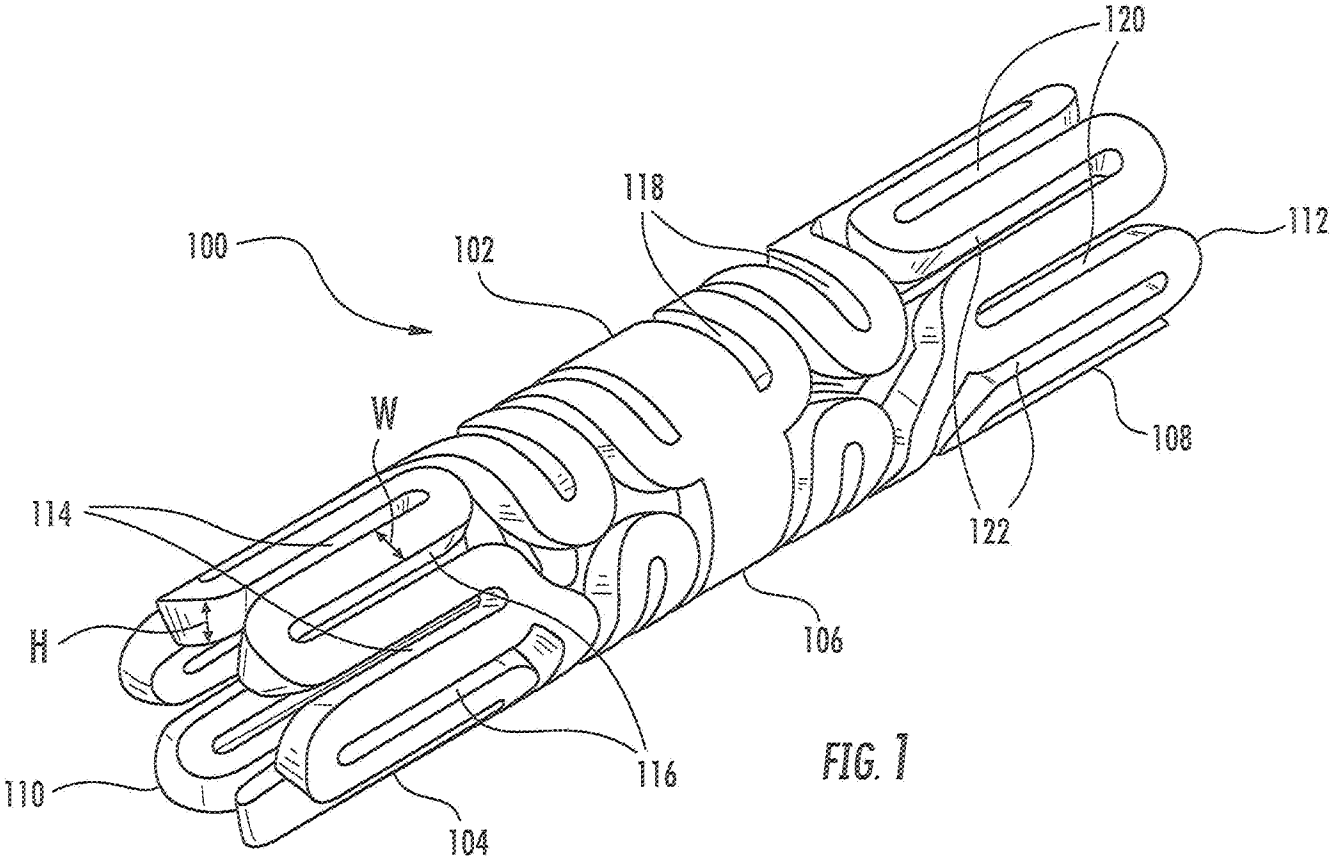
FIG. 1 is a perspective view of an embodiment of a socket contact as disclosed herein.

Reference is now made in detail to the present embodiments of the disclosure, examples of which are illustrated in the accompanying drawings. Whenever possible, identical or similar reference numerals are used throughout the drawings to refer to identical or similar parts. It should be understood that the embodiments disclosed herein are merely examples with each one incorporating certain benefits of the present disclosure. Various modifications and alterations may be made to the following examples within the scope of the present disclosure, and aspects of the different examples may be mixed in different ways to achieve yet further examples. Accordingly, the true scope of the disclosure is to be understood from the entirety of the present disclosure in view of, but not limited to the embodiments described herein.

Referring now to FIG. 1, there is shown a socket contact 100 having a main body 102 extending along a longitudinal axis. Main body 102 may have a proximal portion 104, a distal portion 108, and a central portion 106 that may be axially between proximal portion 104 and distal portion 108. Each of proximal portion 104, distal portion 108, and central portion 106 may have inner and outer surfaces. Main body 102 may also have a first end 110 disposed on proximal portion 104 and an opposing second end 112 disposed on distal portion 108. Main body 102 may be comprised of electrically conductive and mechanically resilient material having spring-like characteristics, for example, that extends circumferentially around the longitudinal axis. Materials for main body 102 may include, but are not limited to, gold plated beryllium copper (BeCu), stainless steel, or a cobalt-chromium-nickel-molybdenum-iron alloy such as Conichrome®, Phynox®, and Elgiloy®.

Socket contact 100 may include a plurality of external openings 114 associated with proximal portion 104. In exemplary embodiments, at least one of external openings 114 extends for a distance from first end 110 along at least a part of the longitudinal length of proximal portion 104 between the inner and outer surfaces of proximal portion 104. Socket contact 100 may include at least one internal opening 116 that may be substantially parallel to openings 114, but does not extend to first end 110. Socket contact 100 may also include other external openings 120 associated with distal portion 108. At least one of external openings 120 extends for a distance from second end 112, along at least a part of the longitudinal length of distal portion 108 between the inner and outer surfaces of distal portion 108. Socket contact 100 may further include at least one other internal opening 122, for example, that may be substantially parallel to openings 120, but does not extend to second end 112.

Continuing with reference to FIG. 1, the openings extending along the longitudinal length of portions 104 and 108 delineate, for example, longitudinally oriented u-shaped slots. Specifically, openings 114, 120 respectively extending from ends 110, 112 and openings 116, 122 respectively not extending to ends 110, 112 delineate longitudinally oriented u-shaped slots. Socket contact 100 may include circumferentially oriented u-shaped slots delineated by a plurality of openings 118 extending at least partially circumferentially around central portion 106. The circumferentially oriented u-shaped slots may be generally perpendicular to longitudinally oriented u-shaped slots.

The longitudinally oriented u-shaped slots delineated by openings 114, 116 and 120, 122 that alternate in opposing directions along the proximal portion 104 and distal portion 108. In other words, the electrically conductive and mechanically resilient material circumferentially extend around the longitudinal axis, for example, in a substantially axially parallel accordion-like pattern, along the proximal portion 104 and distal portion 108. The radially outermost portion of electrically conductive and mechanically resilient material has a width, W, that may be approximately constant along different portions of the axially parallel accordion-like pattern. Additionally, the radially outermost portion of electrically conductive and mechanically resilient material has a height, H. Height H may be approximately constant along different portions of the pattern. The ratio of H/W may be from about 0.5 to about 2.0, such as from about 0.75 to about 1.5, including about 1.0.

Main body 102 may be of unitary construction. In an exemplary embodiment, main body 102 may be constructed from, for example, a thin-walled cylindrical tube of electrically conductive and mechanically resilient material. For example, patterns have been cut into the tube, such that the patterns define, for example, a plurality of openings that extend between the inner and outer surfaces of the tube. The thin wall tube may be fabricated to small sizes (for applications where, for example, small size and low weight are of importance) by various methods including, for example, extruding, drawing, and deep drawing, etc. The patterns may, for example, be laser machined, stamped, etched, electrical discharge machined or traditionally machined into the tube depending on the feature size. In exemplary embodiments, for example, the patterns are laser machined into the tube.

Figure 2:
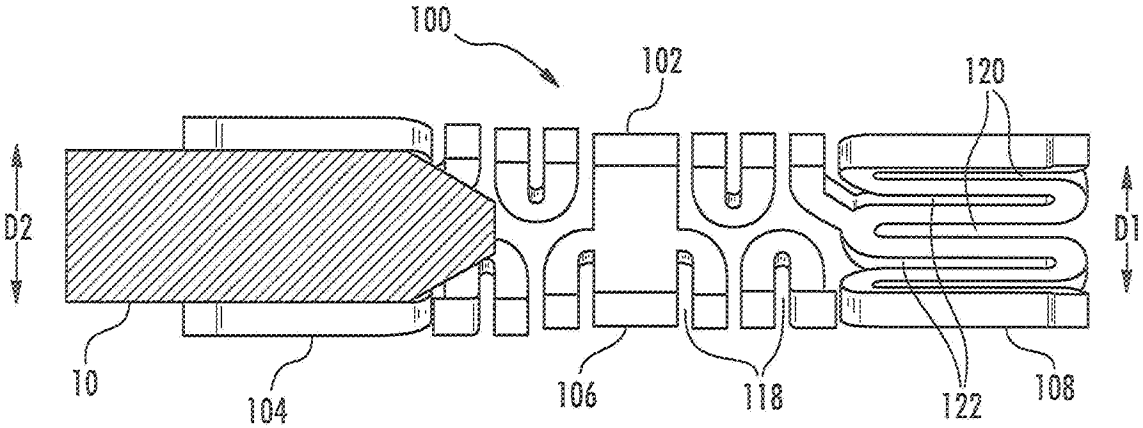
FIG. 2 is a side cutaway view of the socket contact illustrated in FIG. 1, wherein the socket is shown engaging a male pin contact.

Referring now to FIG. 2, socket contact 100 is shown engaging a coaxial transmission medium, for example, a mating (male pin) contact 10. An inner surface of proximal portion 104 and an inner surface of distal portion 108 may each be adapted to engage, for example, circumferentially, an outer surface of mating contact 10. Prior to engagement with mating contact 10, proximal portion 104 and distal portion 108 each have an inner width, or diameter, D1 that may be smaller than an outer diameter D2 of mating contact 10. In some embodiments, engagement of the inner surface of proximal portion 104 or distal portion 108 with outer surface of mating contact 10 may cause portions 104 and 108 to flex radially outwardly. As an example, during such engagement, the inner diameter of proximal portion 104 and/or distal portion 108 may be at least equal to D2. For example, inner diameter of proximal portion 104 may be approximately equal to D2 upon engagement with mating contact 10 while distal portion 108 not being engaged to a mating contact may have an inner diameter of D1. Disengagement of the inner surface of proximal portion 104 and/or distal portion 108 with the outer surface of mating contact 10 may cause inner diameter of proximal portion 104 and/or distal portion 108 to return to D1. While not limited, D2/D1 may be, in exemplary embodiments, at least 1.05, such as at least 1.1, and further such as at least 1.2, and yet further such as at least 1.3. The outward radial flexing of proximal portion 104 and/or distal portion 108 during engagement with mating contact 10 may result in a radially inward biasing force of socket contact 100 on mating contact 10, facilitating transmission of an electrical signal between socket contact 100 and mating contact 10 and also reducing the possibility of unwanted disengagement between socket contact 100 and mating contact 10.

Continuing with reference to FIG. 2, the inner surface of proximal portion 104 and the inner surface of distal portion 108 are adapted to contact the outer surface of mating contact 10 upon engagement with mating contact 10. Proximal portion 104 and distal portion 108 may each have a circular or approximately circular shaped cross-section of uniform or approximately uniform inner diameter of D1 along their longitudinal lengths prior to or subsequent to engagement with mating contact 10. Proximal portion 104 and distal portion 108 may each have a circular or approximately circular shaped cross-section of uniform or approximately uniform inner diameter of at least D2 along a length of engagement with mating contact 10. Put another way, the region bounded by inner surface of proximal portion 104 and the area bounded by inner surface of distal portion 108 each may approximate that of a cylinder having a diameter of D1 prior to or subsequent to engagement with mating contact 10, and the region bounded by inner surface of proximal portion 104 and the area bounded by inner surface of distal portion 108 each may approximate that of a cylinder having a diameter of D2 during engagement with mating contact 10.

Figure 3:
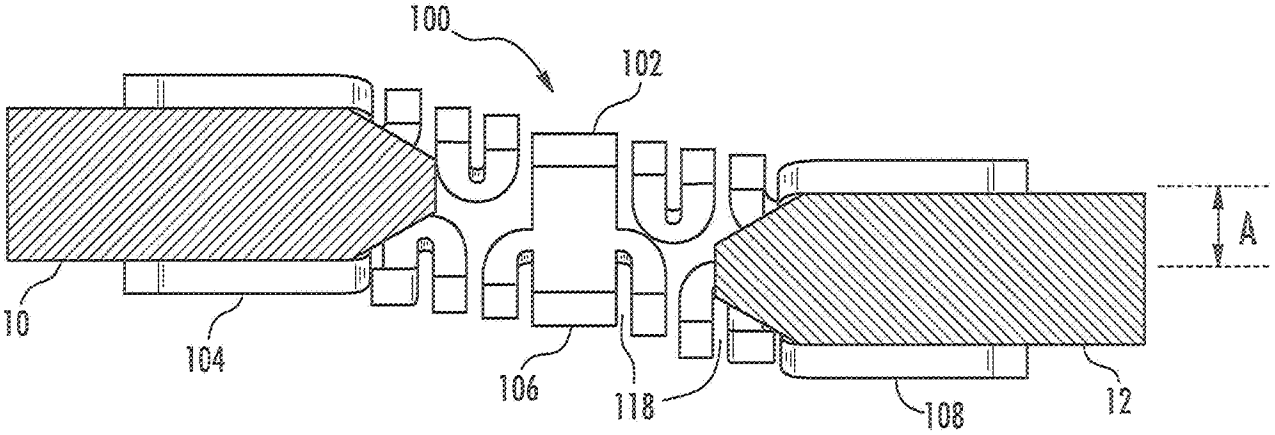
FIG. 3 is a side cutaway view of the socket contact illustrated in FIG. 1, wherein the socket is shown engaging two non-coaxial male pin contacts.

Referring now to FIG. 3, socket contact 100 may simultaneously engage two mating (male pin) contacts 10 and 12. Mating contact 10 may, for example, circumferentially engage proximal portion 104 and mating contact 12 may circumferentially engage distal portion 108. In some embodiments, mating contact 10 may not be coaxial with mating contact 12, resulting in an axial offset distance A (or mated misalignment) between the longitudinal axis of mating contact 10 and the longitudinal axis of mating contact 12.

Socket contact 100 may be adapted to flex, for example, along central portion 106, compensating for mating misalignment between, for example, mating contact 10 and mating contact 12. Types of mating misalignment may include, but are not limited to, radial misalignment, axial misalignment and angular misalignment. For purposes of this disclosure, radial misalignment may be defined as the distance between the two mating pin (e.g., mating contact) axes and may be quantified by measuring the radial distance between the imaginary centerline of one pin if it were to be extended to overlap the other pin. For purposes of this disclosure, axial misalignment may be defined as the variation in axial distance between the respective corresponding points of two mating pins. For purposes of this disclosure, angular misalignment may be defined as the effective angle between the two imaginary pin centerlines and may usually be quantified by measuring the angle between the pin centerlines as if they were extended until they intersect. Additionally, and for purposes of this disclosure, compensation for the presence of one, two or all three of the stated types of mating misalignments, or any other mating misalignments, may be simply characterized by the term "gimbal" or "gimballing." Put another way, gimballing may be described for purposes of this disclosure as freedom for socket contact 100 to bend or flex in any direction and at more than one location along socket contact 100 in order to compensate for any mating misalignment that may be present between, for example, a pair of mating contacts or mating pins, such as mating contacts 10, 12. In exemplary embodiments, socket contact 100 may gimbal between, for example, mating contact 10 and mating contact 12 while still maintaining radially inward biasing force of socket contact 100 on mating contacts 10 and 12. The radially inward biasing force of socket contact 100 on mating contacts 10, 12 facilitates transmission of, for example, an electrical signal between socket contact 100 and mating contacts 10 and 12 and reduces the possibility of unwanted disengagement during mated misalignment.

Continuing with reference to FIG. 3, when mating contact 10 is not coaxial with mating contact 12, the entire inner surface of proximal portion 104 and the entire inner surface of distal portion 108 are adapted to contact the outer surface of mating contacts 10 and 12 upon engagement with mating contacts 10 and 12. Each of proximal portion 104 and distal portion 108 may have a circular or approximately circular shaped cross-section of a nominally uniform inner diameter of D1 along their respective longitudinal lengths prior to or subsequent to engagement with mating contacts 10 and 12. Additionally, each of proximal portion 104 and distal portion 108 may have a circular or approximately circular shaped cross-section of a nominally uniform inner diameter of at least D2 along their longitudinal lengths during engagement with mating contacts 10 and 12. Put another way, the space bounded by inner surface of proximal portion 104 and the space bounded by inner surface of distal portion 108 each may approximate that of a cylinder having a nominal diameter of D1 prior to or subsequent to engagement with mating contacts 10 and 12 and the space bounded by inner surface of proximal portion 104 and the space bounded by inner surface of distal portion 108 each may approximate that of a cylinder having a nominal diameter of D2 during engagement with mating contacts 10 and 12.

Socket contact 100 may gimbal to compensate for a ratio of axial offset distance A to nominal diameter D1, A/D1, to be at least about 0.4, such as at least about 0.6, and further such as at least about 1.2. Further, socket contact 100 may gimbal to compensate for a ratio of axial offset distance A to nominal diameter D2, A/D2 to be at least about 0.3, such as at least about 0.5, and further such as at least about 1.0. In this way, socket contact 100 may gimbal to compensate for the longitudinal axis of mating contact 10 to be substantially parallel to the longitudinal axis of mating contact 12 when mating contacts 10 and 12 are not coaxial, for example, such as when A/D2 may be at least about 0.3, such as at least about 0.5, and further such as at least about 1.0. Further, socket contact 100 may gimbal to compensate for the longitudinal axis of mating contact 10 to be substantially oblique to the longitudinal axis of mating contact 12 when mating contacts 10 and 12 are not coaxial, for example, when the relative angle between the respective longitudinal axes is not 180 degrees.

Figure 4:
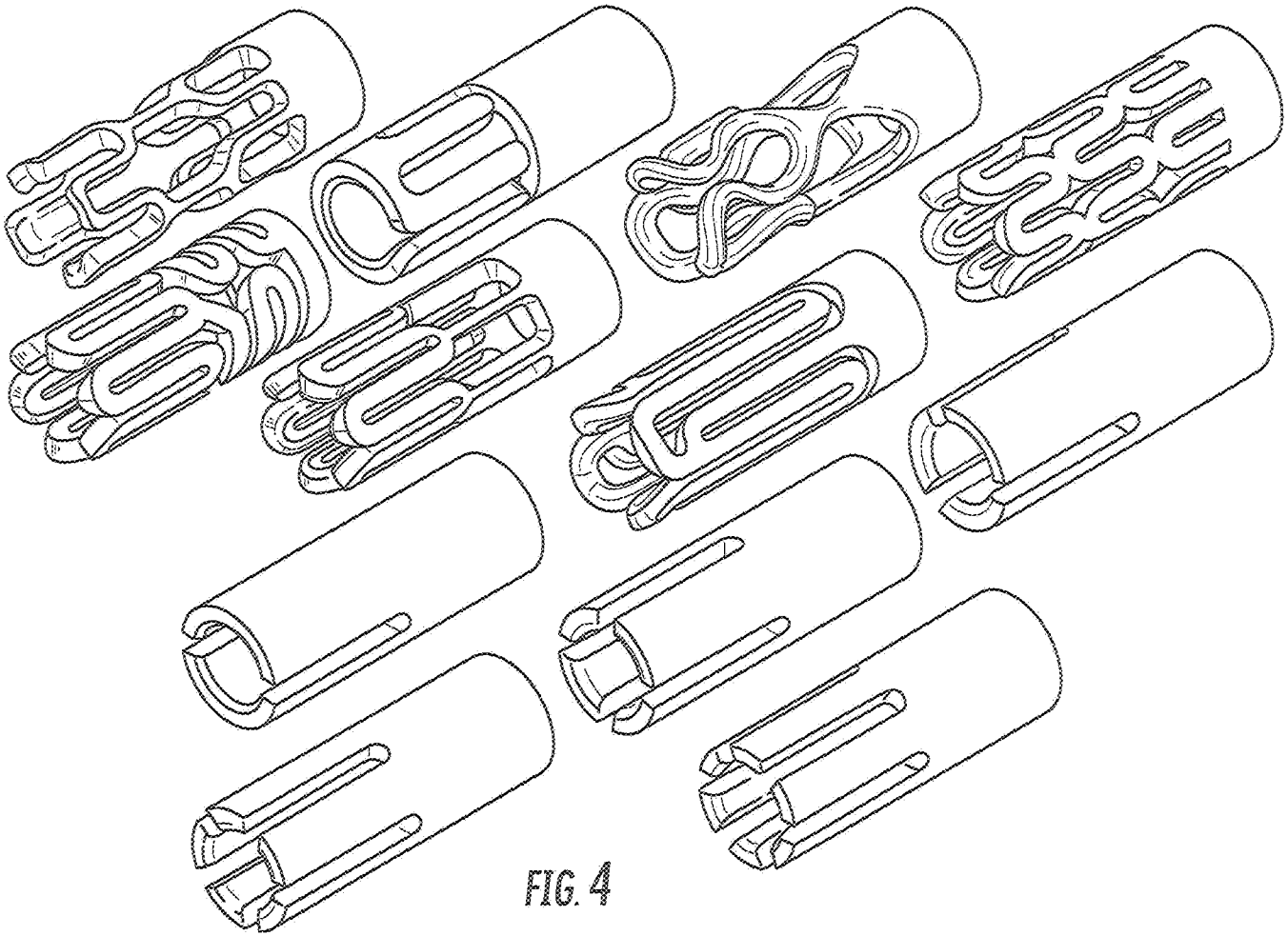
FIG. 4 is perspective views of alternate embodiments of socket contacts as disclosed herein.

Referring now to FIG. 4, various socket contacts having openings cut into only a single end are shown. So called single ended variations may have the proximal portion of the socket adapted to engage, for example, a pin contact and the distal portion of the socket may, for example, be soldered or brazed to, or crimped on, for example, a wire, or, for example, soldered, brazed, or welded to another such contact as, for example, another socket/pin configuration or soldered, brazed, welded, or pressed into a circuit board. As with the socket contact 100 (see FIGS. 1-3), the single ended socket contact variations may be adapted to flex radially and axially along at least a portion of their longitudinal length. The different patterns on the single ended socket contacts may also be found on double ended embodiments, similar to socket contact 100 (see FIGS. 1-3).

Figure 5:
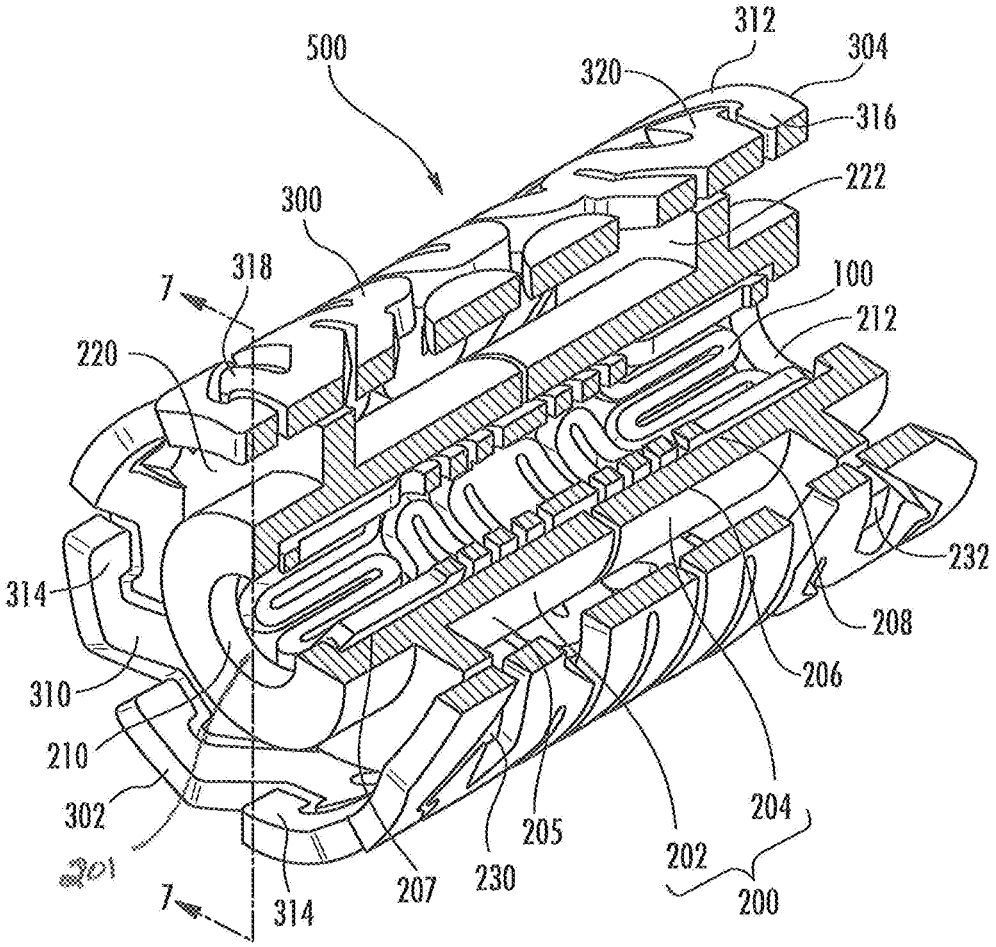
FIG. 5 is a cutaway isometric view of a blind mate interconnect having an outer conductor, an insulator and the socket contact of FIG. 1.
Figure 6:
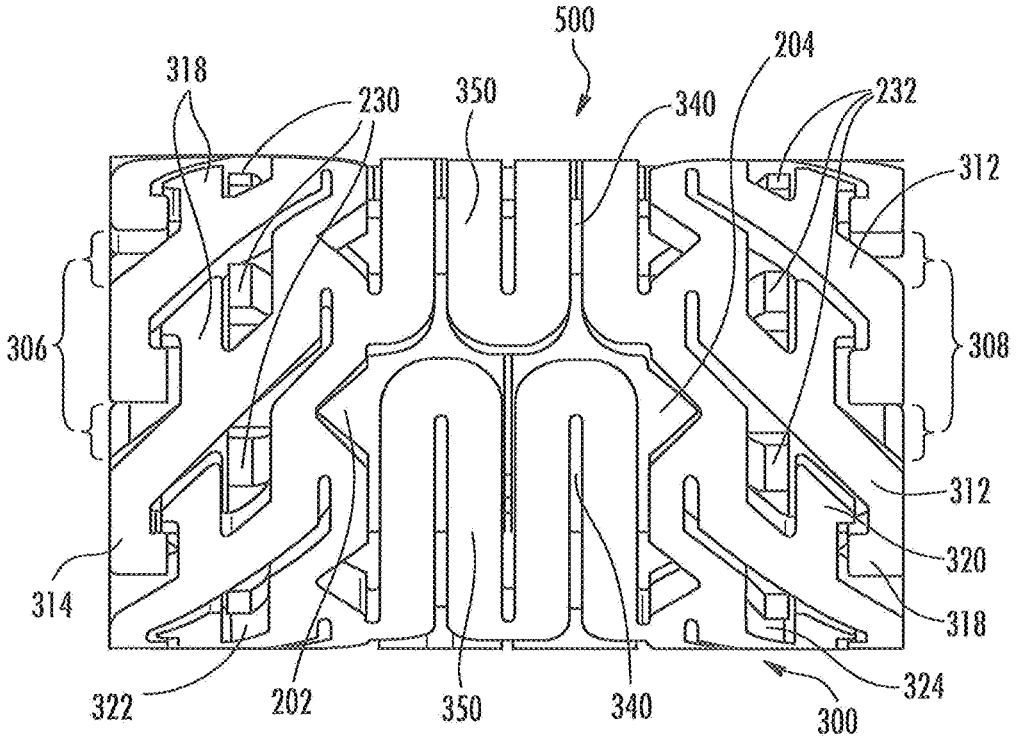
FIG. 6 is a side view of the blind mate interconnect of FIG. 5.
Figure 7:
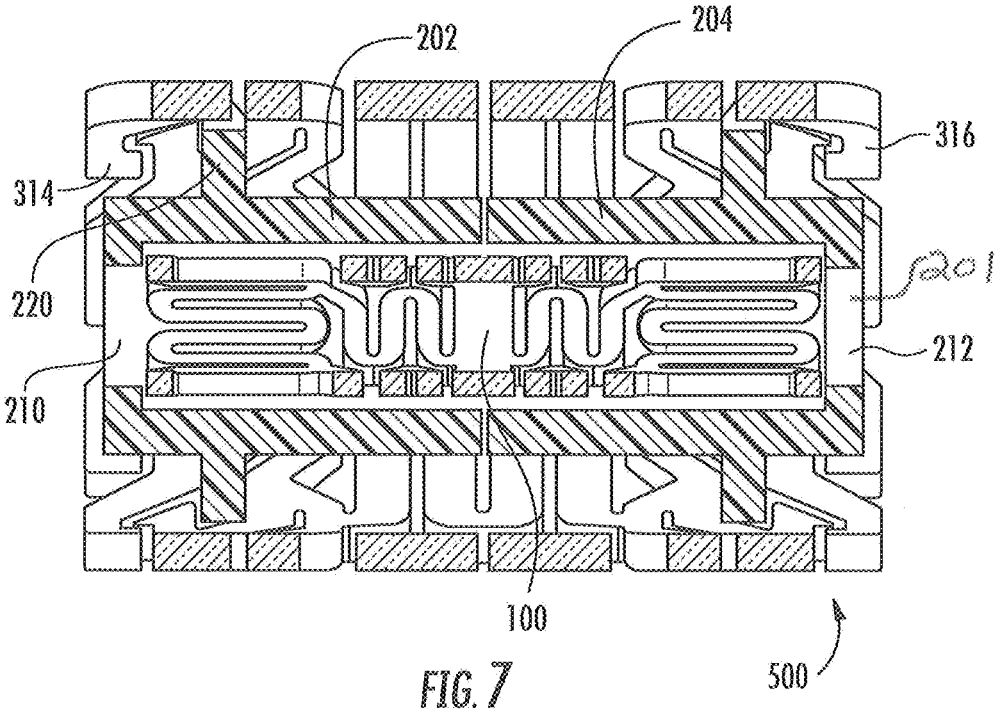
FIG. 7 is a side cross-sectional view of the blind mate interconnect of FIG. 5.

FIGS. 5-7 illustrate a blind mate interconnect 500, which may include, for example, socket contact 100, an insulator 200, and an outer conductor 300. Outer conductor 300 may extend substantially circumferentially about a longitudinal axis $L_1$ and may define a first central bore 301. Insulator 200 may be disposed within the first central bore and may extend substantially about the longitudinal axis $L_1$. Insulator 200 may include a first insulator component 202 and second insulator component 204 that may, for example, cooperate to define a second central bore 201. Socket contact 100 may be disposed within the second central bore 201.

Outer conductor 300 may have a proximal end 302 and a distal end 304, with, for example, a tubular body extending between proximal end 302 and distal end 304. A first radial array of slots 306 may extend substantially diagonally, or helically, along the tubular body of conductor 300 from proximal end 302 for a distance, and a second radial array of slots 308 may extend substantially diagonally, or helically, along the tubular body of conductor 300 from distal end 304 for a distance. Slots 306, 308 may provide a gap having a minimum width of about 0.001 inches. Outer contact, being made from an electrically conductive material, may optionally be plated, for example, by electroplating or by electroless plating, with another electrically conductive material, e.g., nickel and/or gold. The plating may add material to the outer surface of outer conductor 300, and may close the gap to about 0.00075 inches nominal. Helical slots may be cut at an angle of, for example, less than 90 degrees relative to the longitudinal axis (not parallel to the longitudinal axis), such as from about 30 degrees to about 60 degrees relative to the longitudinal axis, and such as from about 40 degrees to about 50 degrees relative to the longitudinal axis.

Slots 306 and 308 may define, respectively, a first array of substantially helical cantilevered beams 310 and a second array of substantially helical cantilevered beams 312. Helical cantilevered beams 310, 312 include, for example, at least a free end and a fixed end. First array of substantially helical cantilevered beams 310 may extend substantially helically around at least a portion of proximal end 302 and a second array of substantially helical cantilevered beams 312 extend substantially helically around at least a portion of distal end 304. Each of helical cantilevered beams 310 may include, for example, at least one retention finger 314 and at least one flange stop 316 and each of plurality of second cantilevered beams 312 includes at least one retention finger 318 and at least one flange stop 320. Slots 306 and 308 each may define at least one flange receptacle 322 and 324, respectively. Flange receptacle 322 may be defined as the space bounded by flange stop 316, two adjacent helical cantilevered beams 310, and the fixed end for at least one of helical cantilevered beams 310. Flange receptacle 324 may be defined as the space bounded by flange stop 318, two adjacent helical cantilevered beams 312, and the fixed end for at least one of helical cantilevered beams 312. Helical cantilevered beams 310 and 312, in exemplary embodiments, may deflect radially inwardly or outwardly as they engage an inside surface or an outside surface of a conductive outer housing of a coaxial transmission medium (see, e.g., FIGS. 8 and 12), for example, providing a biasing force for facilitating proper grounding.

Outer conductor 300 may include, for example, at least one radial array of sinuate cuts at least partially disposed around the tubular body. Sinuate cuts may delineate at least one radial array of sinuate sections, the sinuate sections cooperating with the at least one array of substantially helical cantilevered beams to compensate for misalignment within a coaxial transmission medium, the conductor comprising an electrically conductive material First insulator component 202 may include outer surface 205, inner surface 207 and reduced diameter portion 210. Second insulator component 204 includes outer surface 206, inner surface 208 and reduced diameter portion 212. Reduced diameter portions 210 and 212 allow insulator 200 to retain socket contact 100. In addition, reduced diameter portions 210 and 212 provide a lead in feature for mating contacts 10 and 12 (see, e.g., FIG. 8) to facilitate engagement between socket contact 100 and mating contacts 10 and 12. First insulator component 202 additionally may include an increased diameter portion 220 and second insulator component 204 may also include an increased diameter portion 222 (FIG. 8), increased diameter portions 220, 222 may respectively have at least one flange 230 and 232 that engages outer conductor 300, specifically, respective flange receptacles 322 and 324 (see FIG. 6).

In exemplary embodiments, each of first and second insulator components 202 and 204 are retained in outer conductor portion 300 by first being slid longitudinally from the respective proximal 302 or distal end 304 of outer conductor portion 300 toward the center of outer conductor portion 300 (FIG. 7). First array of substantially helical cantilevered beams 310 and second array of substantially helical cantilevered beams 312 may be flexed radially outward to receive respective arrays of flanges 230 and 232 within respective flange receptacles 322, 324. In exemplary embodiments, flanges 230, 232 reside freely within respective flange receptacles 322, 324, and may not react radially in the event cantilevered beams 310, 312 flex, but may prevent relative axial movement during connection of first and second insulator components 202 and 204 as a connector is pushed or pulled against interconnect 500.

In exemplary embodiments outer conductor portion 300 may be made, for example, of a mechanically resilient electrically conductive material having spring-like characteristics, for example, a mechanically resilient metal or metal alloy. An exemplary material for the outer conductor portion 300 may be beryllium copper (BeCu), which may optionally be plated over with another material, e.g., nickel and/or gold. Insulator 200, including first insulator component 202 and second insulator component 204, may be, in exemplary embodiments, made from a plastic or dielectric material. Exemplary materials for insulator 200 include Torlon® (polyamide-imide), Vespel® (polyimide), and Ultem® (Polyetherimide). Insulator 200 may be, for example, machined or molded. The dielectric characteristics of the insulators 202 and 204 along with their position between socket contact 100 and outer conductor portion 300 produce, for example, an electrical impedance of about 50 ohms. Fine tuning of the electrical impedance may be accomplished by changes to the size and/or shape of the socket contact 100, insulator 200, and/or outer conductor portion 300.

Figure 8:
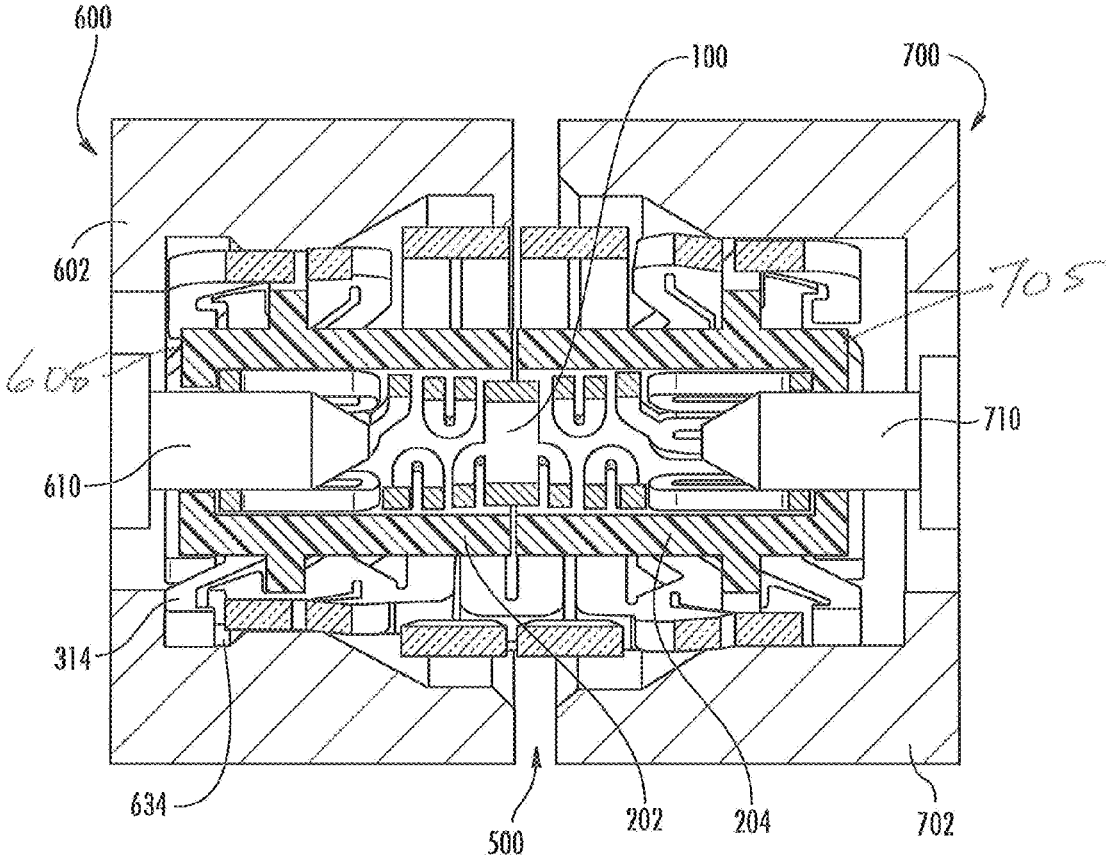
FIG. 8 is another cross-sectional view of the blind mate interconnect of FIG. 5 mated with two coaxial transmission mediums.
Figure 10:
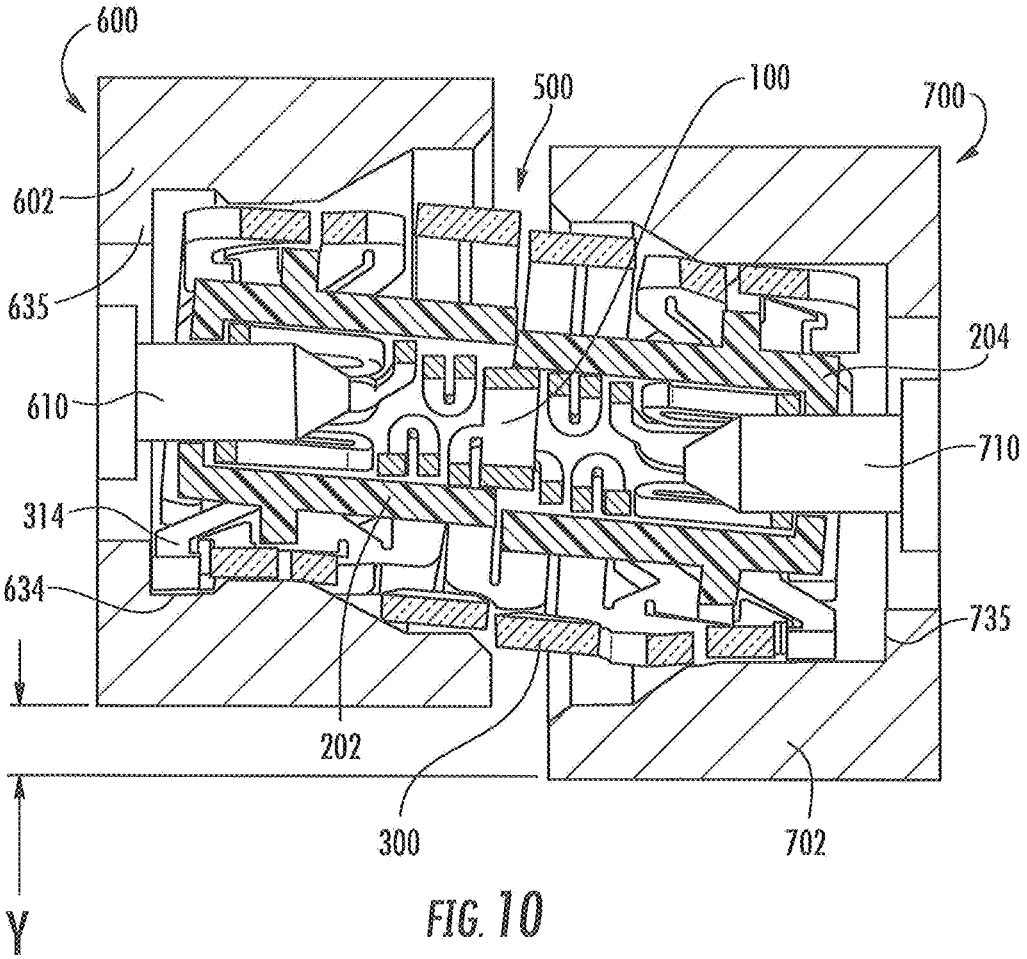
FIG. 10 is a mated side cross-sectional view showing an increased radial misalignment possible with the blind mate interconnect of FIG. 5.

Interconnect 500 may engage with two coaxial transmission mediums, e.g., first and second male connectors 600 and 700, having asymmetrical interfaces (FIG. 8). First male connector 600 may be a detented connector and may include a conductive outer housing (or shroud) 602 extending circumferentially about a longitudinal axis, an insulator, such as dielectric material or air, circumferentially surrounded by the conductive outer housing 602, and a conductive mating contact (male pin) 610 at least partially circumferentially surrounded by the insulator 605, shown in FIG. 8 as dielectric material but can also be air. Second male connector 700 may be, for example, a non-detented or smooth bore connector and also includes a conductive outer housing (or shroud) 702 extending circumferentially about a longitudinal axis, an insulator, such as dielectric material or air, circumferentially surrounding by the conductive outer housing 702, and a conductive mating contact (male pin) 710 at least partially circumferentially surrounded by insulator 705, shown in FIG. 8 as dielectric material but can also be air. Outer conductor 300 may compensate for mating misalignment by one or more of radially expanding, radially contracting, axially compressing, axially stretching, bending, flexing, or combinations thereof. Mating misalignment may be integral to a single connector, for example, male connectors 600 or 700 or between two connectors, for example, both connectors 600 and 700. For example, the array of retention fingers 314 located on the free end of the first array of cantilevered beams 310 may snap into a detent 634 of outer shroud 602, securing interconnect 500 into connector 600. Male pin 610 engages and makes an electrical connection with socket contact 100 housed within insulator 202. Any misalignment that may be present between male pin 610 and outer shroud 602 may be compensated by interconnect 500. A second connector, for example, connector 700, that may be misaligned relative to first connector 600 is compensated for by interconnect 500 in the same manner (see FIG. 10).

Interconnect 500 may engage with two coaxial transmission mediums, e.g., first and second male connectors 600 and 700, having asymmetrical interfaces (FIG. 8). First male connector 600 may be a detented connector and may include a conductive outer housing (or shroud) 602 extending circumferentially about a longitudinal axis, an insulator 605 circumferentially surrounded by the conductive outer housing 602, and a conductive mating contact (male pin) 610 at least partially circumferentially surrounded by insulator 605. Second male connector 700 may be, for example, a non-detented or smooth bore connector and also includes a conductive outer housing (or shroud) 702 extending circumferentially about a longitudinal axis, an insulator 705 circumferentially surrounding by the conductive outer housing 702, and a conductive mating contact (male pin) 710 at least partially circumferentially surrounded by insulator 705.

Figure 9:
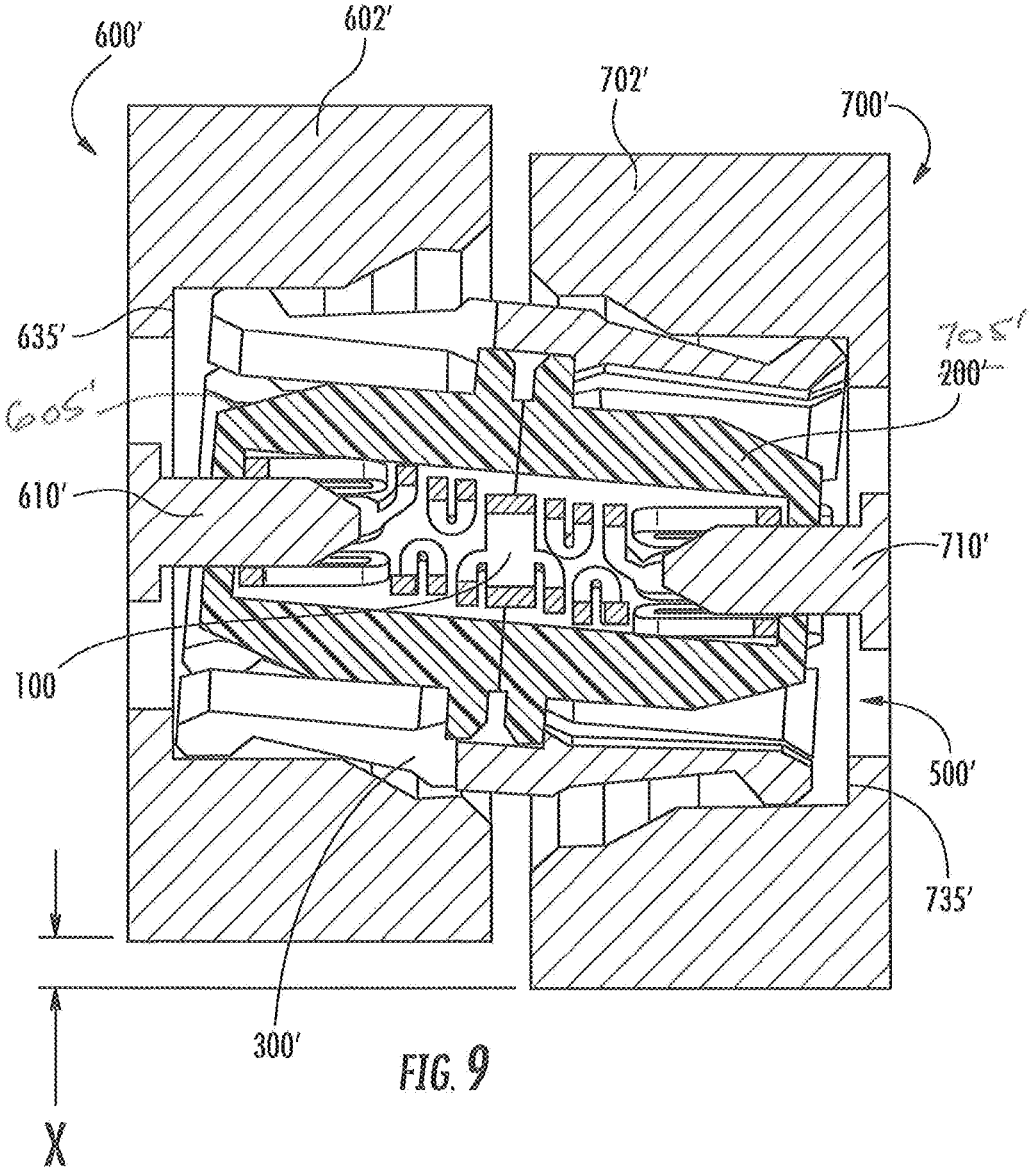
FIG. 9 is a mated side cross-sectional view of an interconnect showing a maximum amount of radial misalignment possible with the interconnect.

In an alternate embodiment, a blind mate interconnect 500' having a less flexible outer conductor 300' may engage with two non-coaxial (misaligned) male connectors 600' and 700 (FIG. 9). Male connector 600' may act as a coaxial transmission medium and may include a conductive outer housing (or shroud) 602' extending circumferentially about a longitudinal axis, an insulator, such as dielectric material or air, circumferentially surrounded by the conductive outer housing 602', and a conductive mating contact (male pin) 610' at least partially circumferentially surrounded by an insulator 605', shown in FIG. 9 as dielectric material but can also be air. Male connector 700' may also act as a coaxial transmission medium and may include a conductive outer housing (or shroud) 602' extending circumferentially about a longitudinal axis, an insulator, such as dielectric material or air, circumferentially surrounded by the conductive outer housing 602', and a conductive mating contact (male pin) 610' at least partially circumferentially surrounded by an insulator 705', shown in FIG. 9 as dielectric material but can also be air.

Conductive outer housings 602' and 702' may be electrically coupled to outer conductor portion 300' and mating contacts 610' and 710' may be electrically coupled to socket contact 100. Conductive outer housings 602' and 702' each may include reduced diameter portions 635' and 735', which may each act as, for example, a mechanical stop or reference plane for outer conductor portion 300'. As disclosed, male connector 600' may not be coaxial with male connector 700'. Although socket contact 100 may be adapted to flex radially, allowing for mating misalignment (gimballing) between mating contacts 610' and 710', less flexible outer shroud 300' permits only amount "X" of radial misalignment. Outer conductor 300 (see FIG. 10), due to sinuate sections 350 and arrays 310, 312 of helical cantilevered beams, may permit amount "Y" of radial misalignment. "Y" may be from 1.0 to about 3.0 times amount "X" and in exemplary embodiments may be about 1.5 to about 2.5 times amount "X."

Figure 11:
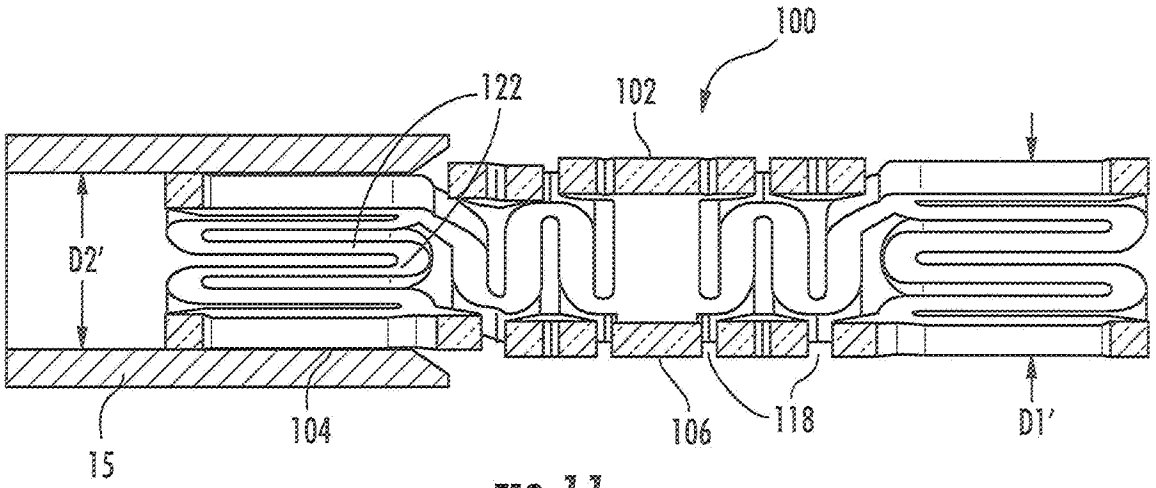
FIG. 11 is a side cross-sectional view of the socket contact of FIG. 1 being mated inside of a tube instead of over a pin.

In alternate exemplary embodiments, socket contact 100 may engage a coaxial transmission medium, for example, a mating (female pin) contact 15 (FIG. 11). An outer surface of proximal portion 104 and an outer surface of distal portion 108 may each be adapted to engage, for example, circumferentially, an inner surface of mating contact 15. Prior to engagement with mating contact 10, proximal portion 104 and distal portion 108 each have an outer width, or diameter, D1' that may be larger than an inner diameter D2' of mating contact 15. In some embodiments, engagement of the outer surface of proximal portion 104 or distal portion 108 with inner surface of mating contact 15 may cause portions 104 and 108 to flex radially inwardly. As an example, during such engagement, the outer diameter of proximal portion 104 and/or distal portion 108 may be at least equal to D2' (FIG. 11). In the example, outer diameter of proximal portion 104 may be approximately equal to D2' upon engagement with mating contact 15 while distal portion 108 not being engaged to a mating contact may have an outer diameter of D1'. Disengagement of the outer surface of proximal portion 104 and/or distal portion 108 with the inner surface of mating contact 15 may cause outer diameter of proximal portion 104 and/or distal portion 108 to return to D1'. While not limited, D1'/D2' may be, in exemplary embodiments, at least 1.05, such as at least 1.1, and further such as at least 1.2, and yet further such as at least 1.3. The inward radial flexing of proximal portion 104 and/or distal portion 108 during engagement with mating contact 15 may result in a radially outward biasing force of socket contact 100 on mating contact 15, facilitating transmission of an electrical signal between socket contact 100 and mating contact 15 and also reducing the possibility of unwanted disengagement between socket contact 100 and mating contact 15.

In exemplary embodiments, the outer surface of proximal portion 104 and the outer surface of distal portion 108 are adapted to contact the inner surface of mating contact 15 upon engagement with mating contact 15. In exemplary embodiments, proximal portion 104 and distal portion 108 may each have a circular or approximately circular shaped cross-section of uniform or approximately uniform inner diameter of D1' along their longitudinal lengths prior to or subsequent to engagement with mating contact 15. In exemplary embodiments, proximal portion 104 and distal portion 108 may each have a circular or approximately circular shaped cross-section of uniform or approximately uniform outer diameter of at least D2' along a length of engagement with mating contact 15. Put another way, the region bounded by outer surface of proximal portion 104 and the area bounded by outer surface of distal portion 108 each, in exemplary embodiments, approximates that of a cylinder having outer diameter of D1' prior to or subsequent to engagement with mating contact 15, and the region bounded by inner surface of proximal portion 104 and the area bounded by inner surface of distal portion 108 each, in exemplary embodiments, approximates that of a cylinder having an outer diameter of D2' during engagement with mating contact 15.

Figure 12:
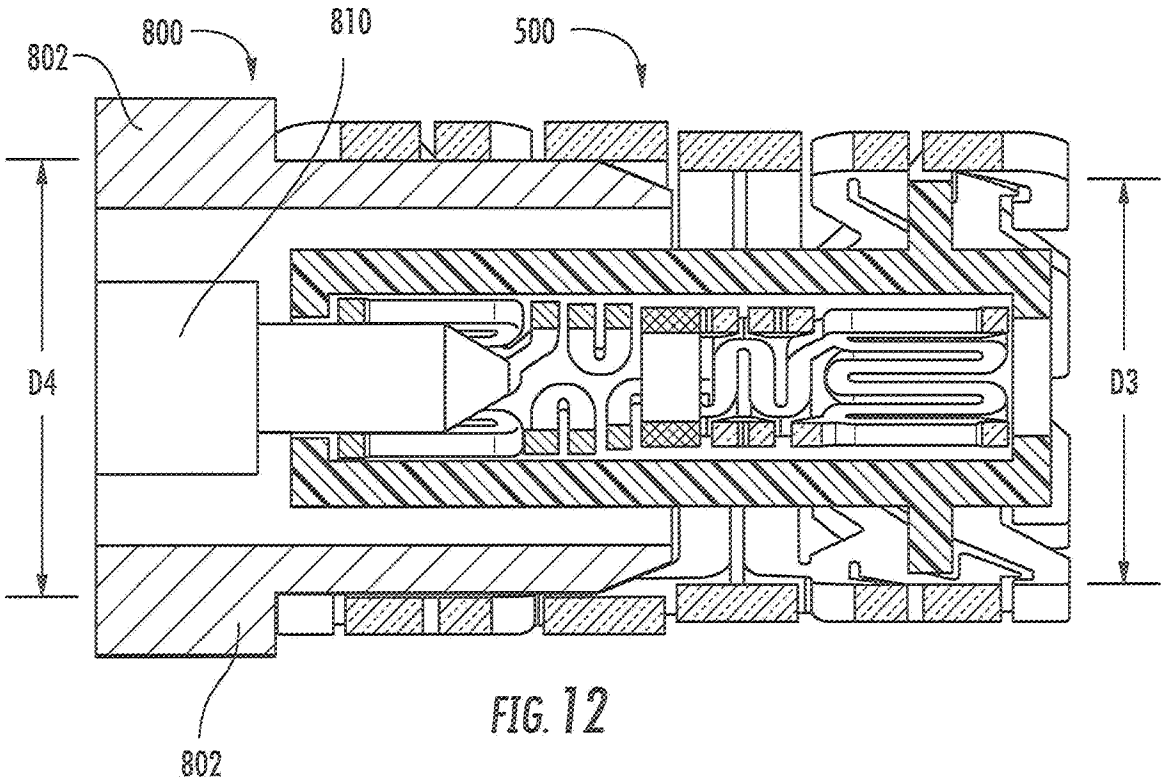
FIG. 12 is a side cross-sectional view of the blind mate interconnect of FIG. 5 showing the outer conductor mating over an outside diameter rather than within an inside diameter.

In some embodiments, blind mate interconnect 500 may engage a coaxial transmission medium, for example, a mating (male pin) contact 800 (FIG. 12) having a male outer housing or shroud 802. An inner surface of proximal portion 104 and an inner surface of distal portion 108 may each be adapted to engage, for example, circumferentially, an outer surface of mating contact 810 and an inner surface of proximal portion 302 and an inner surface of distal portion 304 of outer conductor 300 may engage an outer surface of male outer housing 802. Prior to engagement with male outer housing 802, proximal portion 302 and distal portion 304 each have an inner width, or diameter, D3 that may be smaller than an outer diameter D4 of male outer housing 802. In some embodiments, engagement of the inner surface of proximal portion 302 or distal portion 304 with outer surface of male outer housing 802 may cause portions 302 and 304 to flex radially outwardly. As an example, during such engagement, the inner diameter of proximal portion 302 and/or distal portion 304 may be at least equal to D4 (FIG. 12). In the example, inner diameter of proximal portion 302 may be approximately equal to D4 upon engagement with male outer housing 802 while distal portion 304 not being engaged to a male outer housing may have an inner diameter of D3. Disengagement of the inner surface of proximal portion 302 and/or distal portion 304 with the outer surface of male outer housing 802 may cause inner diameter of proximal portion 302 and/or distal portion 304 to return to D3. While not limited, D4/D3 may be, in exemplary embodiments, at least 1.05, such as at least 1.1, and further such as at least 1.2, and yet further such as at least 1.3. The outward radial flexing of proximal portion 302 and/or distal portion 304 during engagement with male outer housing 802 may result in a radially inward biasing force of outer conductor 300 on male outer housing 802, facilitating transmission of an electrical signal between outer conductor 300 and male outer housing 802 and also reducing the possibility of unwanted disengagement between outer conductor 300 and male outer housing 802.

Figure 13:
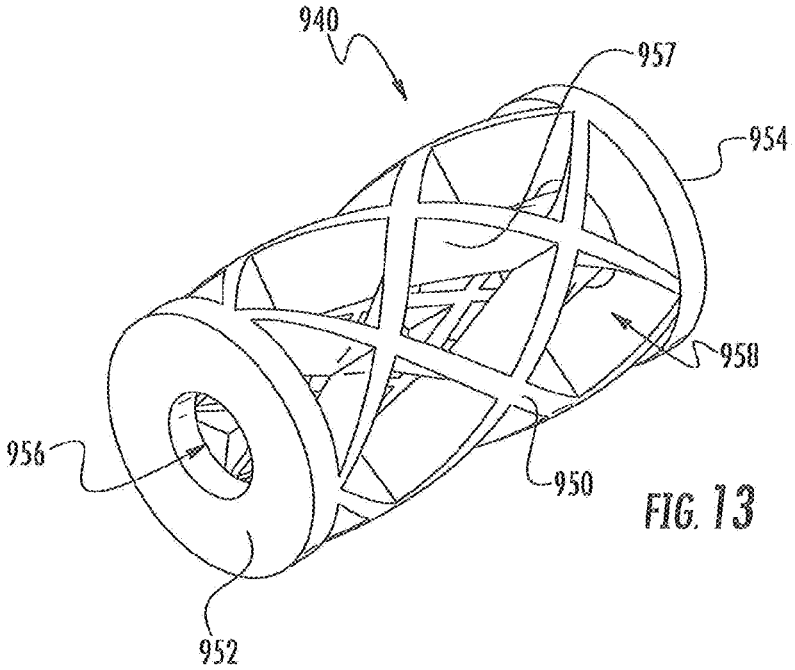
FIG. 13 is a perspective view of an exemplary embodiment of an insulator with dielectric material laser cut to incorporate voids into the insulator.
Figure 14:
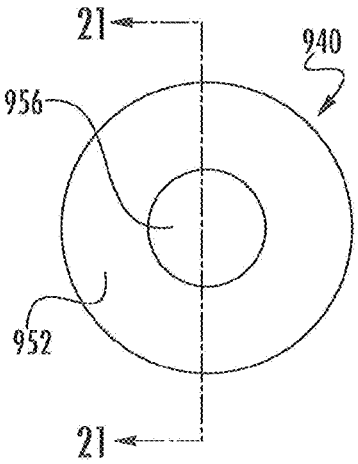
FIG. 14 is an end view of the insulator of FIG. 13.
Figure 15:
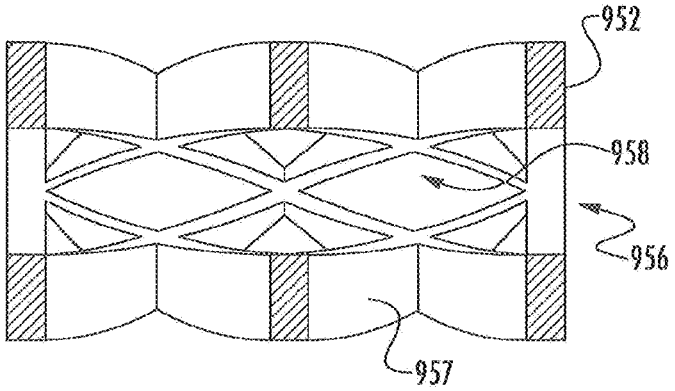
FIG. 15 is a cross-sectional view of the insulator of FIG. 13.

FIGS. 13-15 illustrate exemplary embodiments of insulators constructed from a dielectric material having a structure or pattern resulting from a laser cutting process. Laser cutting allows for various structures or patterns, including complex patterns, which may not be commercially or technically feasible using conventional machining, molding or extruding techniques. Whether by laser cutting or conventional methods, the purpose of structuring or patterning the insulator is to remove dielectric material to achieve certain results, including, without limitation, lowering the tangent delta, reducing the composite dielectric constant and increasing the flexibility of the insulator.

The lower the tangent delta of an insulator, the less loss that will occur in the connector from the dielectric. Dry air has a tangent delta of zero and, therefore, no dielectric loss will occur from air. However, the tangent delta of all dielectric materials is greater than air. As such, incorporating holes or voids in the dielectric material results in an insulator with a composite tangent delta value that is in-between that of the air and the dielectric material without the holes or voids. It follows then, that the resultant tangent delta of an insulator depends on the tangent delta of the dielectric material chosen and the ratio of dielectric material to air in a particular cross section of the insulator. The dielectric material can be any material that is not an electrical conductor. The most common dielectric materials used for RF microwave connectors are plastic, as non-limiting examples Teflon®, Ultem® or Torlon®, and glass.

Another reason to remove dielectric material is to reduce the composite dielectric constant of the insulator. This is very similar to reducing the tangent delta, except that it results in a lower loss connector for a given diameter of insulator. Because of this, the insulator can be reduced in size, including having a smaller diameter, while maintaining the same required impedance of the connector, as an example, 50 ohms. The dielectric constant of dry air is 1.0 and all other dielectric materials have dielectric constants greater than 1.0. Additionally, depending on the actual pattern laser cut into the dielectric material to incorporate more air, the more flexible the insulator may become allowing a coaxial connector to accommodate more gimbaling and/or radial misalignment of the transmission media connected to the coaxial connector, while maintaining dielectric properties to insulate and separate components of the coaxial connector. Although embodiments herein illustrate the insulator incorporated in a blind mate interconnect, it should be understood that the insulator can be used in any type of connector, including, but not limited to, any type of coaxial connector.

Referring to FIGS. 13-15, perspective, end and cross-sectional views of an insulator 940 are shown. Insulator 940 may be constructed from a continuous, single piece of dielectric material or multiple pieces of dielectric material. In both cases the insulator 940 is laser cut in a certain structure or pattern. In FIGS. 13-15, insulator 940 is shown as having tubular body 950, first end 952 and second end 954 with through bore 956 extending axially from ends 952 to 954. At least one void 958 may be disposed along body 950, and may extend from through bore 956 outward through body 950, forming in some instances a passage from outside of insulator 940 to the through bore 956. Although in FIGS. 13-15, insulator 940 is shown made by laser cutting a pattern through the extruded dielectric material, other manufacturing methods may be contemplated and are within the scope of this disclosure.

However, laser cutting allows the insulator 940 to have more intricate and complex patterns cut into the dielectric material. For example, the plurality of voids 958 shown in FIGS. 13-15 has a diamond pattern, but many other patterns are possible and could be used. In this way, having more intricate and complex patterns allows more of the insulator 940 to comprise voids 958, in other words, comprise more air, increasing the insulators 940 flexibility without compromising the structural integrity of the insulator 940 or affecting the insulator's 940 ability to separate and insulate the coaxial connector components. Having more voids 958 incorporating more air into the insulator lowers the tangent delta and reduces the composite dielectric constant of the insulator 940, improving the electrical and mechanical performance between, for example, a conductive transmission medium and a coaxial connector.

It will be apparent to those skilled in the art that various modifications and variations can be made without departing from the spirit or scope of the disclosure. Since modifications combinations, sub-combinations and variations of the disclosed embodiments incorporating the spirit and substance of the disclosure may occur to persons skilled in the art, the disclosure should be construed to include everything within the scope of the appended claims and their equivalents.

What is claimed is:

1. An insulator for a coaxial connector adapted to connect to a coaxial transmission medium to form an electrically conductive path between the transmission medium and the coaxial connector, the insulator comprising:

dielectric material; and a laser-cut pattern in the insulator producing voids in the dielectric material such that air is incorporated into the insulator, wherein the insulator has a composite tangent delta and a composite dielectric constant based on a combination of the dielectric material and the air, and maintains dielectric properties to insulate and separate components of the coaxial connector, wherein the pattern repeats itself in a rotational direction around a rotational axis of the insulator, and the pattern repeats itself in an axial direction parallel to the rotational axis.

2. The insulator of claim 1, wherein the at least one void is diamond shaped.

3. The insulator of claim 1, wherein the dielectric material is one unitary piece.

4. The insulator of claim 1, wherein the dielectric material is multiple pieces.

5. The insulator of claim 1, wherein the coaxial connector is a blind mate interconnect.

6. The insulator of claim 1, wherein at least one void is disposed along body.

7. The insulator of claim 6, wherein the at least one void extends from the through bore outward through body.

8. The insulator of claim 7, wherein the at least one void forms a passage from outside of the insulator to the through bore.

9. A blind mate interconnect adapted to connect to a coaxial transmission medium to form an electrically conductive path between the transmission medium and the blind mate interconnect, the blind mate interconnect comprising:

a socket contact adapted for receiving a mating contact of coaxial transmission medium, wherein the socket contact extends circumferentially about a longitudinal axis and comprises an electrically conductive material;

at least one insulator comprising dielectric material circumferentially disposed about the socket contact, the at least one insulator including a body having a first end and second end and a through bore extending from the first end to the second end; and an outer conductor circumferentially disposed about the insulator, wherein the outer conductor comprises an electrically conductive material; and an inner conductor disposed entirely within the insulator and retained within the insulator such that the entire inner conductor is bendable relative the insulator, wherein the insulator is laser cut in a pattern producing voids in the dielectric material such that air is incorporated into the insulator, wherein the insulator has a composite tangent delta and a composite dielectric constant based on a combination of the dielectric material and the air, and wherein the insulator maintains dielectric properties to insulate and separate components of the coaxial connector, wherein the pattern repeats itself in a rotational direction around a rotational axis of the insulator, and the pattern repeats itself in an axial direction parallel to the rotational axis.

10. The blind mate interconnect of claim 9, wherein the at least one void is diamond shaped.

11. The blind mate interconnect of claim 9, wherein the dielectric material is one unitary piece.

12. The blind mate interconnect of claim 9, wherein the dielectric material is multiple pieces.

13. The blind mate interconnect of claim 9, wherein at least one void is disposed along body.

14. The blind mate interconnect of claim 13, wherein the at least one void extends from the through bore outward through body.

15. The blind mate interconnect of claim 14, wherein the at least one void forms a passage from outside of the insulator to the through bore.

* * * * *